US009340402B2

(12) United States Patent
Clusserath

(10) Patent No.: US 9,340,402 B2
(45) Date of Patent: May 17, 2016

(54) LIFTING ELEMENT WITH EXTENSIBLE RINSE SLEEVE

(75) Inventor: Ludwig Clusserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 154 days.

(21) Appl. No.: 14/241,940

(22) PCT Filed: Jun. 22, 2012

(86) PCT No.: PCT/EP2012/002633

§ 371 (c)(1),
(2), (4) Date: Feb. 28, 2014

(87) PCT Pub. No.: WO2013/029705

PCT Pub. Date: Mar. 7, 2013

(65) Prior Publication Data

US 2014/0216604 A1 Aug. 7, 2014

(30) Foreign Application Priority Data

Aug. 30, 2011 (DE) ..... 10 2011 111 496

(51) Int. Cl.

| | |
|---|---|
| ***B65B 1/04*** | (2006.01) |
| ***B67C 3/24*** | (2006.01) |
| *B67C 3/00* | (2006.01) |
| *B67C 3/26* | (2006.01) |

(52) U.S. Cl.

CPC ..... *B67C 3/244* (2013.01); *B67C 3/004* (2013.01); *B67C 3/005* (2013.01); *B67C 2003/2668* (2013.01)

(58) Field of Classification Search

CPC ..... B67C 3/004; B67C 3/005; B67C 3/22; B67C 3/244; B67C 2003/2668

USPC ..... 141/90, 277

See application file for complete search history.

(56) References Cited

FOREIGN PATENT DOCUMENTS

| | | |
|---|---|---|
| DE | 34 05 365 | 8/1985 |
| DE | 37 22 495 | 1/1989 |
| DE | 43 43 425 | 6/1995 |
| JP | 60 096299 | 7/1985 |

*Primary Examiner* — Jason K Niesz

(74) *Attorney, Agent, or Firm* — Occhiuti & Rohlicek LLP

(57) ABSTRACT

A supporting-and-lifting device for filling stations on a filling machine has a base element, a container carrier including a component that moves parallel to a filling-element axis, an auxiliary lifting element integrated in the container carrier, and a further piston mounted centrally in the auxiliary lifting element. The piston has a head plate. The auxiliary lifting element has, at its upper end, a container plate made from its collar-shaped upper and the head plate. The lifting element can be raised for cleaning or disinfecting. The lifting element is movable by the filling element into a sealed position. The piston is movable independently of the lifting element in a direction parallel to the filling element axis. In a work position, which represents a vertically lower end position, the piston and the lifting element in the sealed position define a rinse sleeve.

9 Claims, 3 Drawing Sheets

LIFTING ELEMENT WITH EXTENSIBLE RINSE SLEEVE

RELATED APPLICATIONS

This application is the national stage entry under 35 USC 371 of PCT application PCT/EP2012/002633, filed on Jun. 22, 2012, which claims the benefit of the Aug. 30, 2011 priority date of German application DE 10 2011 111 496.7, the contents of which are herein incorporated by reference.

FIELD OF INVENTION

The invention relates to filling machines for filling containers, and in particular, to a lifting device used in such filling machines.

BACKGROUND

In container handling installations, in particular in an installation that is used by a beverage manufacturer in the beverages industry for filling containers with a liquid bulk product, it is often necessary to provide lifting devices that press beverage containers, such as glass bottles, against a handling station. In the event of faults in the filling machine, regular cleaning routines or product changes, it is necessary to clean the filling machine. To achieve this, it is common for filling machines to be fitted with rinse caps that close the outlets of the filling valves and so allow an internal circulation of cleaning media.

Some filling valves have a central filling pipe that is inserted into the bottle during the filling process. For these cases, the rinse cap must be made in the shape of a sleeve or beaker.

DE 37 22 495 discloses a filling machine with a lifting device for bottles in which, on each lifting device, an arm with one end is fixed such that it can swivel around a swivel axis that lies on a horizontal plane, i.e. on a plane that is both perpendicular to the filling machine axis and perpendicular to the axis along which the lifting device lifts. On the other end of the arm, a rinse sleeve is attached. By swiveling the arm out of a rest position, in which the rinse sleeve is arranged radially offset from the filling element axis and with its open side pointing downwards, one can swivel it into a prepared position or intermediate position. In this position, the rinse sleeve lies on the same axis as the filling element axis, with its open side pointing upwards and with its top side being gripped from underneath by a forked container carrier on an edge or flange radially distanced over the circumference of the rinse sleeve. By means of the lifting device, which also serves to press the particular bottle, during filling, against the filling element, the rinse sleeve is then moved out of the intermediate position into a work position.

A disadvantage of this arrangement is that to move the rinse sleeve out of the rest position into the work position, a not inconsiderable space is required. Furthermore, the known lifting device requires a container or bottle carrier that grips the bottles to be filled from underneath on a mouth bead.

DE 43 43 425 A1 discloses a filling machine with a lifting device for bottles. On this lifting device there is a folding container plate and an auxiliary lifting device with an integrated rinse sleeve. The auxiliary lifting device can be moved pneumatically between a rest position and a work position. A disadvantage of this arrangement is that to move the container carrier, a not inconsiderable space is again required.

SUMMARY

The purpose of the invention is to disclose a supporting-and-lifting device that has a compact and simplified structure that does not require too much space.

The supporting-and-lifting device according to the invention has, in addition to the known lifting element, with which the lifting of the container carrier is generated, two further lifting elements, an auxiliary lifting element and a piston, that cooperate to cause movement of the particular rinse sleeve between the rest position and the work position, preferably exclusively in the direction of a filling element axis.

In the rest position, the particular pistons of the rinse sleeve are in an upper end position and, on their top side, form an upper surface, the container carrier, which is preferably a container plate and made without stages or grooves such that foreign substances, such as glass fragments, dust etc., cannot contaminate the particular rinse sleeve during filling.

A particular advantage of the invention lies also in the fact that the filling machine can be transferred by the extensible rinse sleeves provided attached to the lifting devices, i.e. can be moved out of the rest position into the work position, e.g. after the end of production, without any manual intervention simply, for example, by issuing a corresponding control command or by retrieving a corresponding program from the machine, into a fully automatic CIP or SIP cleaning operation. The insertion or mounting of rinse sleeves that has hitherto been necessary is thus rendered superfluous.

The supporting-and-lifting device concerned is part of filling stations that each have one filling element or of a filling machine for filling bottles, cans or similar containers with a liquid bulk product with precisely these filling stations. Moreover, the supporting-and-lifting device includes a base element and a container carrier and rinse sleeve, the entirety of which or a partial component of which can be moved up and down in its axial direction parallel to the filling element axis. Moreover, a piston-like auxiliary lifting element is integrated in the container carrier, which can be raised for cleaning and/or disinfection purposes and can be brought with the filling element into a sealed position. In addition, in the container carrier, there is a further piston that is mounted centrally in the auxiliary lifting element and that can be moved independently of the auxiliary lifting element parallel to the filling element axis. Moreover, two end positions are possible, namely a work position and a rest position. The work position is the vertically lower end position of the piston in which it, together with the auxiliary lifting element, likewise in its work position, is formed as a rinse sleeve. To hold a container securely, the container carrier has on its top end a carrying plate that is formed from the collar-shaped top part of the auxiliary lifting element and the head plate of the piston.

In a variant of the supporting and lifting device, the piston is mounted centrally in the auxiliary lifting element or can preferably be moved against the direction of movement of the auxiliary lifting element and parallel to a filling element axis. Moreover, individual driving means can be provided for the piston and the auxiliary lifting device. One such driving means, which is preferred, is an electro-magnetic drive. In this way, the piston and/or the auxiliary lifting device can be moved into a pre-defined position.

With a purely pneumatic drive solution, on one side of the piston, a pressure space is provided. This pressure space is exposed to a pressure medium by means of a control line that has a control valve. This pressure medium is generally compressed air, or possibly sterile compressed air. By exposure to pressure, the piston can thus be moved in the direction of the filling valve axis relative to the auxiliary lifting element. This variant is a particularly economical solution as only the line for the pressure medium is provided and no drives are needed. By the appropriate selection of the internal surface conditions, a fully automatic movement of the elements arranged concentrically and telescopically to each other is possible.

In an alternative embodiment of the supporting-and-lifting device, the pressure space of the piston and/or the auxiliary lifting device is connected by a control valve to a vacuum source and/or a pressure source. Particularly advantageous with this solution is the dual use of the control line. The line in this case is used both for the exposure to pressure and also for the exposure to vacuum of the pressure spaces of the piston and the auxiliary lifting device.

The auxiliary lifting device with integrated connecting lines, preferably in the form of drilled holes, represents a further improvement of the supporting and lifting device. Moreover, the pressure space of the piston is connected to the pressure space of the auxiliary lifting device by means of drilled holes in the auxiliary lifting device. The space underneath the piston is moreover connected to the atmosphere and thus prevents an unwanted build-up of pressure in the pressure-release space. The diameters of the drilled holes of the connecting lines are designed such that the piston and the auxiliary lifting device adopt the desired speed of movement.

In an alternative embodiment of the supporting and lifting device, control valves, preferably butterfly valves, are inserted into the connecting lines. Particularly advantageous here is that the time of movement and the speed of movement of the piston and the auxiliary lifting device are set by the butterfly valves.

Within the meaning of the invention, the term "containers" means, in particular cans, bottles, tubes, pouches, made of metal, glass and/or plastic, as well as other packaging means that are suitable for filling with liquid or viscous products for pressure filling or for pressure-free filling.

BRIEF DESCRIPTION OF THE DRAWINGS

The invention is explained in more detail below by means of exemplary embodiments shown in the figures, in which:

In FIG. 1, the supporting and lifting device 1 is shown in an embodiment that comprises a base element 3 shown in a schematic representation and a container carrier 4 shown in full section. An auxiliary lifting element 5 and a piston 6 are arranged within the container carrier 4. On the upper surface of the lifting element 5 there is formeda container plate 10. A container 2 is pressed against a filling element 11. A vacuum source 7 and a pressure source 8 are connected to a first pressure space 15 in the container carrier 4 by a control valve 12.

As shown in FIG. 1, the vacuum source 7 acts, by means of the control valve 12, on the first pressure space 15 and, by means of a connecting hole 13, on a second pressure space 14, and also holds the auxiliary lifting element 5 and the piston 6 in a rest position 1. A pressure-release hole 20 connects the atmosphere to a pressure-release space 21 and thereby prevents an unwanted build-up of pressure in this area. The base element 3, which is attached to a carousel that is not illustrated, is embodied as a pneumatic cylinder with a piston rod 16. The supporting-and-lifting device 1 can be moved along the filling element axis 18 as a result of exposure provided by pressure from the pressure source 9. A controller, which is not illustrated, controls this movement. In addition, cams and a wheel 19 located on the base element 3 control the supporting-and-lifting device 1 and can thus move it into a defined position.

In FIG. 2, the supporting and lifting device 1 is shown, as in FIG. 1, in the rest position I. What is different, however, is that the control valve 12 is set so that the pressure space 15, and by means of the connecting hole 13, also the pressure space 14 are both exposed to a pressure medium from the pressure source 8. The pressure-release hole 20 connects the pressure-release space 21 to the atmosphere, thus preventing an unwanted build-up of pressure in this area. The switch-over process shown in FIG. 2 is necessary when the filler changes its operating status from "Filling" to "Cleaning."

Figure 1:
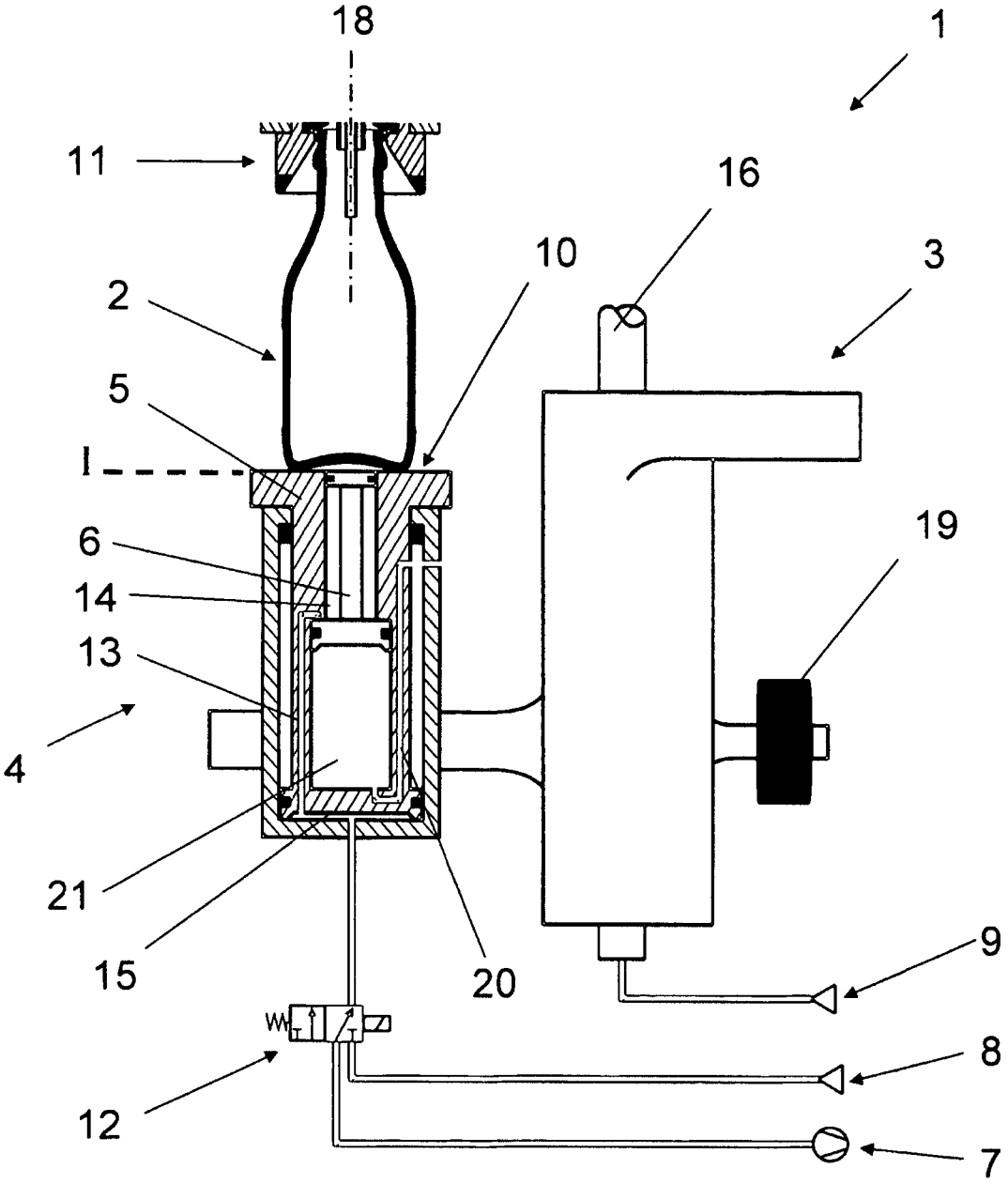
FIG. 1 shows a schematic representation of a lifting device with a container located on the filling valve in a sealed position and a rinse sleeve in the rest position.
Figure 2:
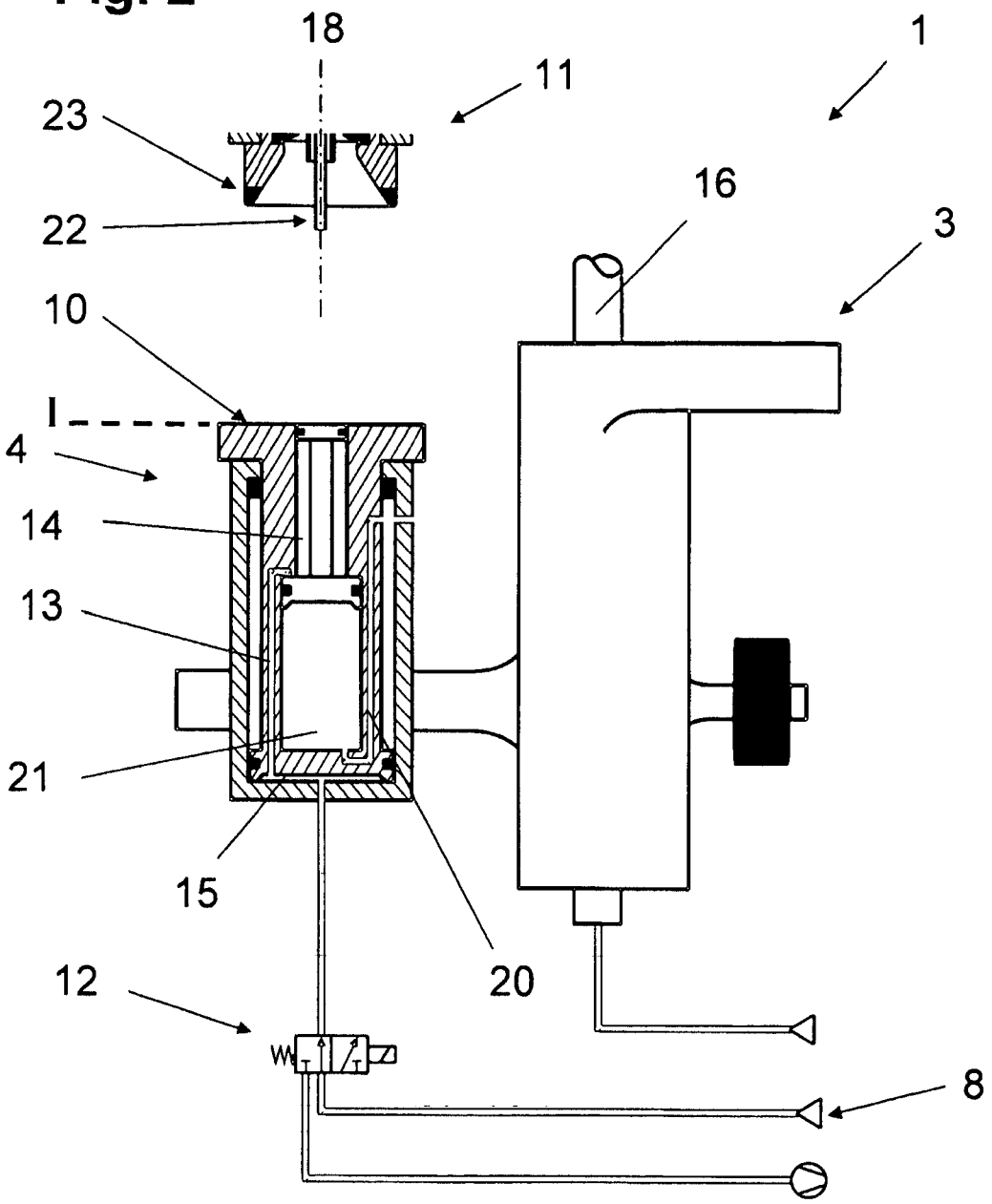
FIG. 2 shows a schematic representation of a lifting device in the rest position without a container.
Figure 3:
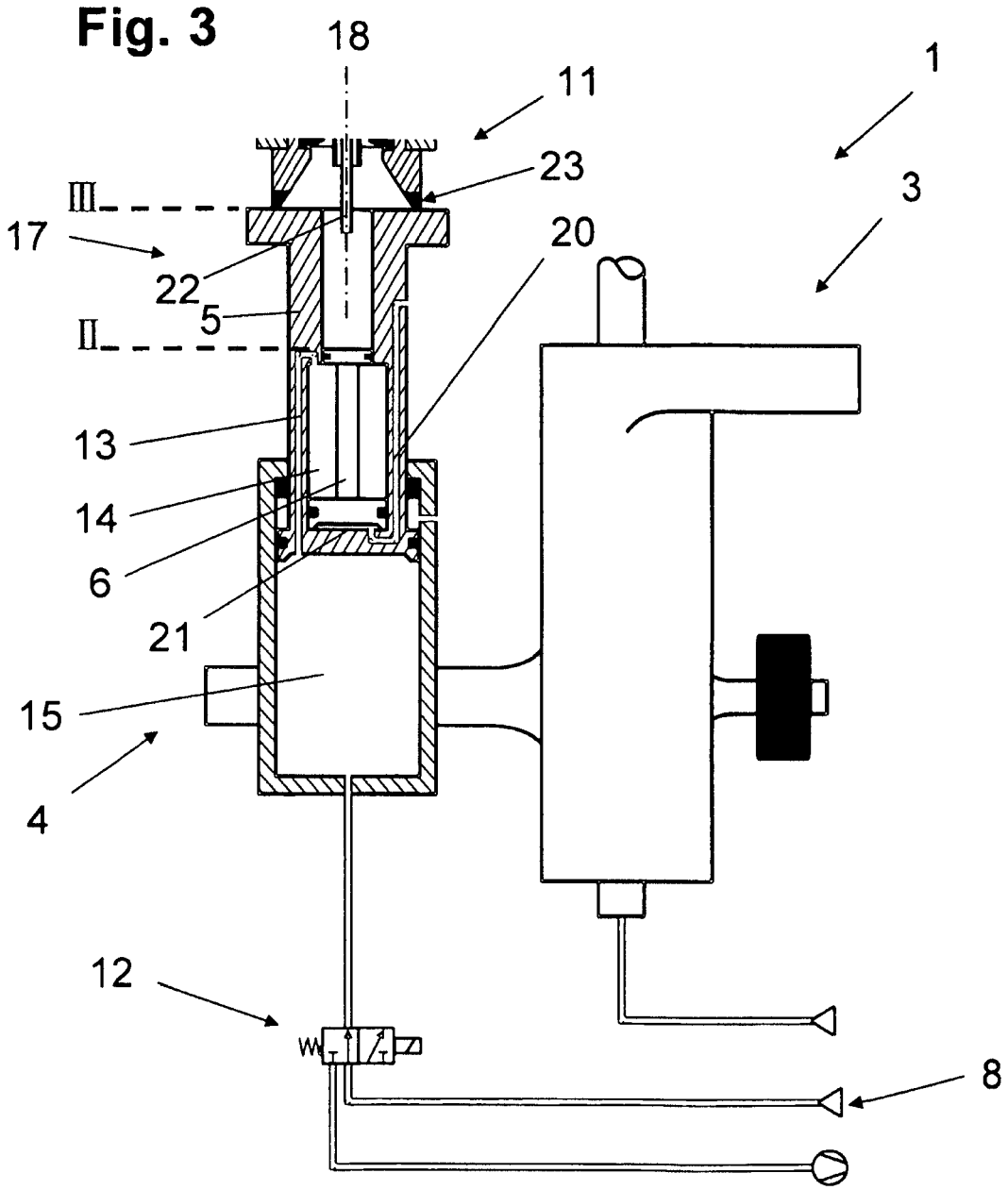
FIG. 3 shows a schematic representation of a lifting device in the cleaning cycle, during which the rinse sleeve is in a sealed position with the filling valve.

The position of rinse sleeves during cleaning is shown in FIG. 3. The control valve 12 switches the pressure medium from the pressure source 8 to the pressure space 15 and by means of the connecting hole 13 to the pressure space 14. As a result, the pressure-release hole 20 connects the pressure-release space 21 to the atmosphere and thus prevents an unwanted build-up of pressure in this area. The piston 6, which is in the work position II, is moved out of the area of a fill level probe 22. The auxiliary lifting device 5 is in the work position III and is pressed against the seal 23 and is thus in a sealed position with the filling element 11. The position shown in FIG. 3 allows the cleaning of the filling valves.

REFERENCE SYMBOL LIST

1 Supporting and lifting device
2 Container, bottle
3 Base element
4 Container carrier and CIP rinse sleeve
5 Auxiliary lifting element
6 Piston
7 Vacuum source
8 Pressure source, base element
9 Pressure source
10 Container carrier, container plate
11 Filling element
12 Control valve
13 Connecting hole
14 Pressure space, piston
15 Pressure space, auxiliary lifting device
16 Piston rod
17 Rinse sleeve
18 Filler element axis
19 Guide roller
20 Pressure-release hole
21 Pressure-release space
22 Fill-level probe
23 Seal
I Rest position
II Work position, piston
III Work position, auxiliary lifting device

The invention claimed is:

1. An apparatus comprising a supporting-and-lifting device for filling stations provided on a filling machine for filling containers with a liquid bulk product using a filling element, wherein said supporting-and-lifting device comprises a base element, a container carrier comprising at least a component that can be moved up and down in an axial direction parallel to a filling element axis, a piston-like auxiliary lifting element integrated in the container carrier, and a further piston that is mounted centrally in said piston-like auxiliary lifting element, said further piston comprising a head plate, wherein said piston-like auxiliary lifting element comprises, at an upper end thereof, a container plate that is made from a collar-shaped upper part of said piston-like auxiliary lifting element and said head plate, wherein said piston-like auxiliary lifting element can be raised for at least one of cleaning and disinfecting, wherein said auxiliary lifting element is movable by said filling element into a sealed position, wherein said further piston is movable independently of said piston-like auxiliary lifting element in a direction parallel to said filling element axis, and wherein, in a work position, which represents a vertically lower end position, said further piston, together with said piston-like auxiliary lifting element in said sealed position defines a rinse sleeve.

2. The apparatus of claim 1, wherein said further piston is mounted centrally in said piston-like auxiliary lifting element, and wherein said further piston can be moved against a direction of movement of said piston-like auxiliary lifting element in a direction parallel to said filling element axis.

3. The apparatus of claim 1, wherein said supporting-and-lifting device further comprises a pressure space provided on one side of said further piston, wherein said pressure space (14) is exposable, by a control line that has a control valve, to a pressure medium, wherein said further piston is movable relative to said piston-like auxiliary lifting element along said filling valve axis as a result of pressure from said pressure medium.

4. The apparatus of claim 3, wherein said supporting-and-lifting device further comprises a vacuum source connected to said pressure space by said control valve.

5. The apparatus of claim 1, wherein said supporting-and-lifting device further comprises a pressure space on one side of said piston-like auxiliary lifting element, wherein said pressure space is exposable, by a control line that has a control valve, to a pressure medium, and wherein said auxiliary lifting element is movable relative to said base element along said filling valve axis as a result of exposure to pressure from said pressure medium.

6. The apparatus of claim 5, wherein said supporting-and-lifting device further comprises a vacuum source connected to said pressure space by said control valve.

7. The apparatus of claim 1, wherein said supporting-and-lifting device further comprises a connecting line in said auxiliary lifting device, said connecting line connecting a first pressure space to a second pressure space.

8. The apparatus of claim 1, wherein said connecting line comprises a drilled hole.

9. The apparatus of claim 1, wherein said supporting-and-lifting device further comprises a connecting line in said piston-like auxiliary lifting device that a pressure-release space to one of ambient pressure and a pressure medium.

* * * * *